US005820533A

United States Patent [19]

Goldman

[11] Patent Number: 5,820,533

[45] Date of Patent: Oct. 13, 1998

[54] ARM/SHOULDER EXERCISE WALKING VEST

[76] Inventor: Jay R. Goldman, 72 Aspen Dr., Woodbury, N.Y. 11797-3022

[21] Appl. No.: 820,967

[22] Filed: Mar. 19, 1997

[51] Int. Cl.[6] ..... A63B 21/02

[52] U.S. Cl. ..... 482/124; 482/125; 482/74

[58] Field of Search ..... 482/124, 121, 482/122, 126, 74

[56] References Cited

U.S. PATENT DOCUMENTS

| | | | |
|---|---|---|---|
| 650,656 | 5/1900 | Raabe . | |
| 1,402,179 | 1/1922 | Piscitelli . | |
| 2,097,376 | 10/1937 | Marshman . | |
| 5,306,222 | 4/1994 | Wilkinson | 482/124 |
| 5,358,461 | 10/1994 | Bailey . | |
| 5,372,565 | 12/1994 | Burdenko | 482/124 |
| 5,647,827 | 7/1997 | Gutkowski et al. | 482/124 |

*Primary Examiner*—Lynne A. Reichard
*Attorney, Agent, or Firm*—Michael I. Kroll

[57] ABSTRACT

An arm/shoulder exercise walking vest (10) comprising a belt (12) worn about a waist (14) of a person (16). A pair of shoulder straps (18) are secured to the belt (12) and worn on a torso (20) of the person (16). A plurality of rings (22) are provided. A structure (24) is for affixing the rings (22) in spaced apart relationships to the shoulder straps (18) and the belt (12). A plurality of elastic bands (26) of varying resistances are also provided. A facility (28) is for attaching in a removable manner a first end (30) of one elastic band (26) to one of the rings (22). The elastic band (26) can be pulled through any other of the rings (22) and grasped at a second end (32) by a hand (34) to be used by the person (16) for exercising an arm/shoulder (36) while walking.

1 Claim, 6 Drawing Sheets

FIG'S 4A - 4E

ARM/SHOULDER EXERCISE WALKING VEST

BACKGROUND OF THE INVENTION

1. Field of the Invention

The instant invention relates generally to exercising devices and more specifically it relates to an arm/shoulder exercise walking vest.

2. Description of the Prior Art

Numerous exercising devices have been provided in prior art. For example, U.S. Pat. Nos. 650,656 to Raabe; 1,402,179 to Piscitelli; 2,097,376 to Marshman and 5,358,461 to Bailey, Jr. all are illustrative of such prior art. While these units may be suitable for the particular purpose to which they address, they would not be as suitable for the purposes of the present invention as heretofore described.

Raabe discloses exercising apparatus utilizing shoulder straps with elastic sections. The device is not designed for use while walking, lacking the details of the present invention.

Piscitelli has exercising apparatus incorporating a vestlike portion with hand grips and looped strands connected to the hand grips. This patent lacks the manner of changing the resilient sections and shifting of the resilient sections as in the present invention.

Marshman shows an exerciser using a harness with an adjustable waist girdle, chest strap and footwear members. The arrangement is not designed for use while walking. In addition, the manner of attaching the resilient section is different than that of the present invention and thus lacks the capability to provide the diversity of exercises possible by the present invention. Other differences will be evident from the detailed description of the present invention.

Bailey discloses an exerciser with generator operated lights for lighting the path of the exerciser. The arrangement employs weights attached to the hand grips for enhancing the exercise effect of moving the arms. The arrangement lacks the use of resilient sections employed as in the present invention.

SUMMARY OF THE INVENTION

A primary object of the present invention is to provide an arm/shoulder exercise walking vest that will overcome the shortcomings of the prior art devices.

Another object is to provide an arm/shoulder exercise walking vest in which an interchangeable varying resistant color coded elastic band can be connected thereto, to enable a person wearing the vest to exercise an arm/shoulder when walking.

An additional object is to provide an arm/shoulder exercise walking vest in which the vest can be quickly placed upon he torso of the person and secured by an adjustable belt worn about the waist, so that the elastic band attached to a ring on the vest can be pulled through another ring to exercise the arm/shoulder when walking.

A further object is to provide an arm/shoulder exercise walking vest that is simple and easy to use.

A still further object is to provide an arm/shoulder exercise walking vest that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
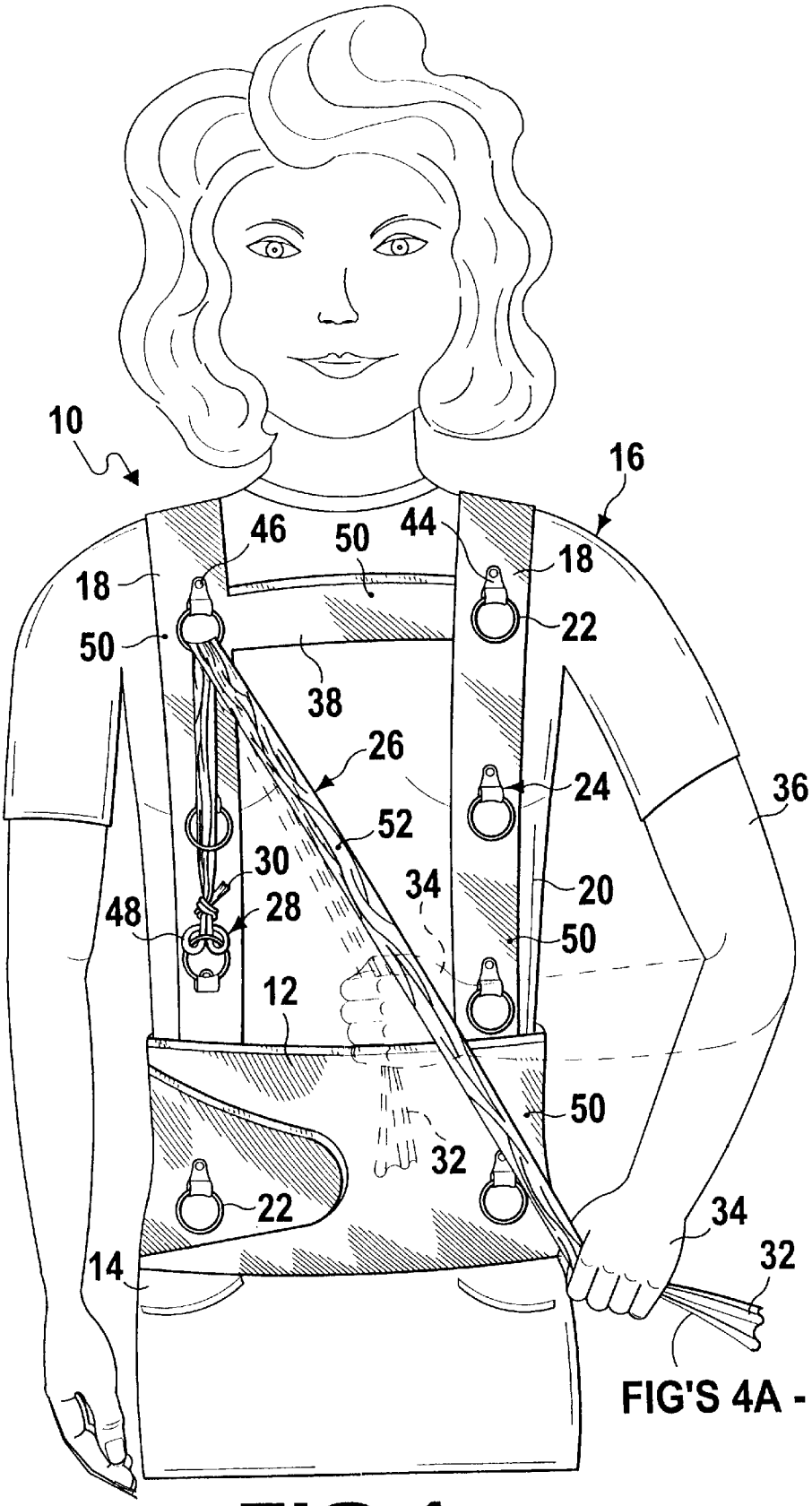
FIG. 1 is a front perspective view of the instant invention worn on a person and in use.
Figure 2:
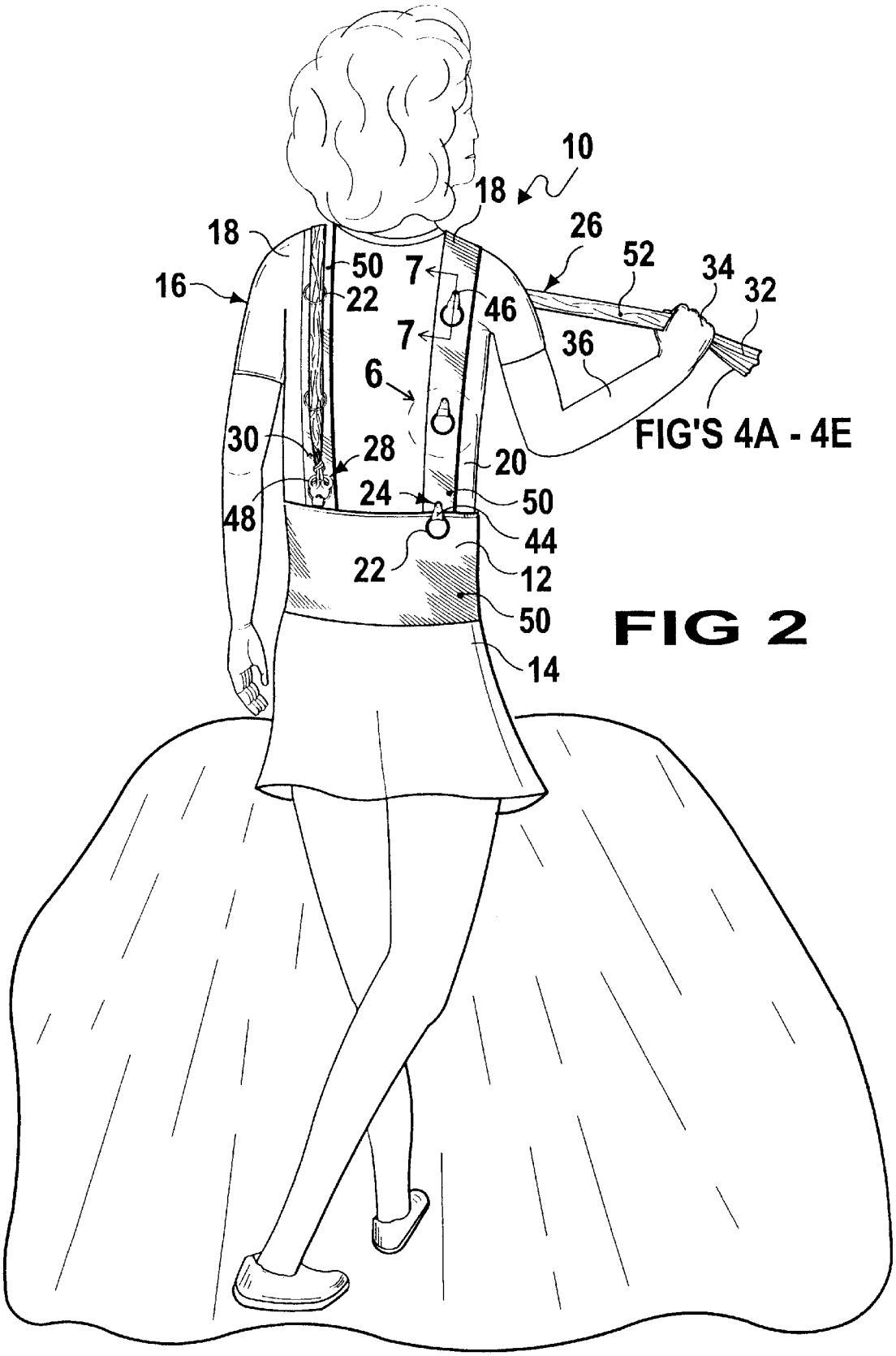
FIG. 2 is a rear perspective view of the instant invention worn on the person and in use.

Turning now descriptively to the drawings, in which similar reference characters denote similar elements throughout the several views, FIGS. 1 to 7 illustrate an arm/shoulder exercise walking vest 10 comprising a belt 12 worn about a waist 14 of a person 16. A pair of shoulder straps 18 are secured to the belt 12 and worn on a torso 20 of the person 16. A plurality of rings 22 are provided. A structure 24 is for affixing the rings 22 in spaced apart relationships to the shoulder straps 18 and the belt 12. A plurality of elastic bands 26 of varying resistances are also provided. A facility 28 is for attaching in a removable manner a first end 30 of one elastic band 26 to one of the rings 22. The elastic band 26 can be pulled through any other of the rings 22 and grasped at a second end 32 by a hand 34, to be used by the person 16 for exercising an arm/shoulder 36 while walking.

Figure 3:
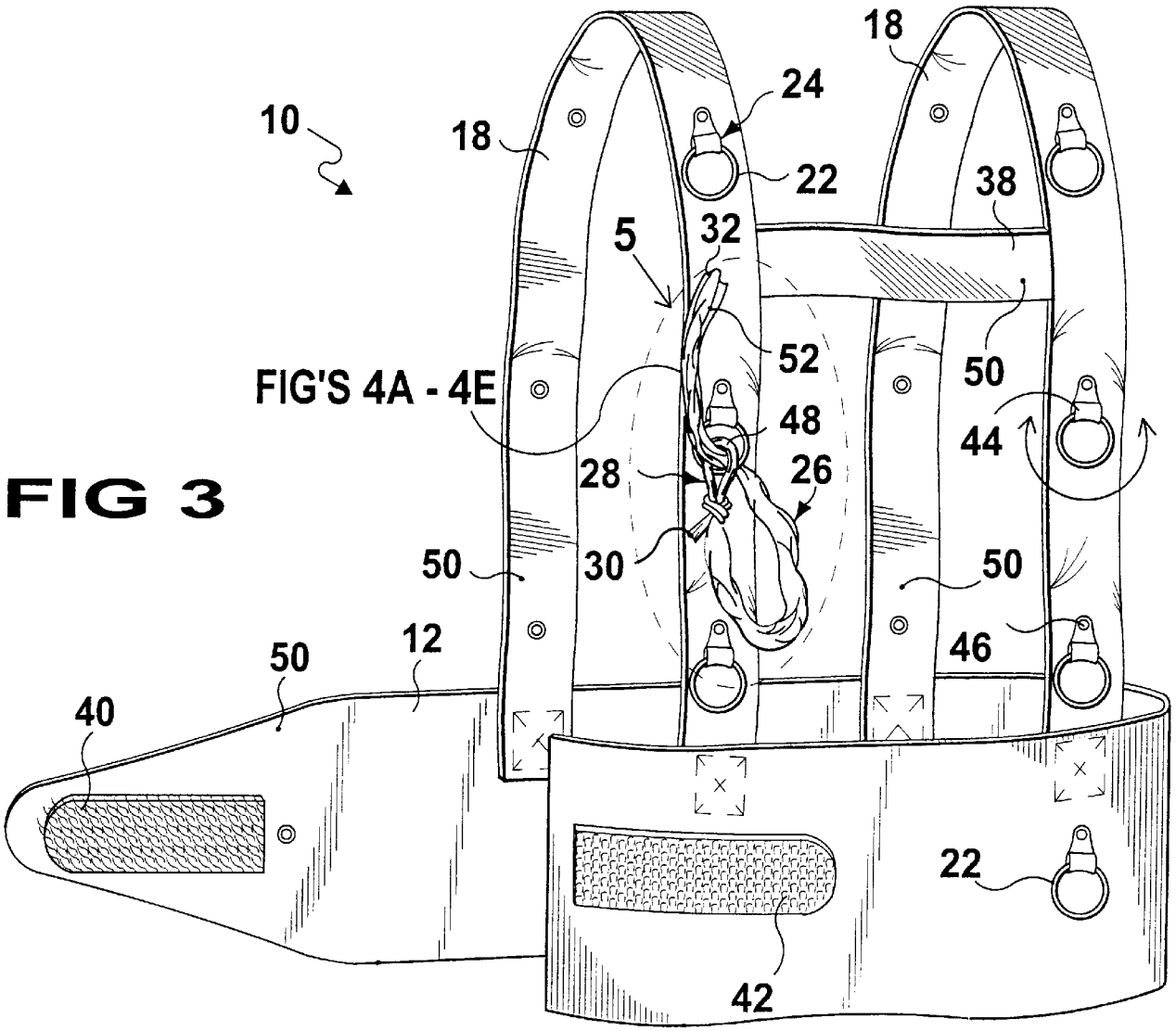
FIG. 3 is a front perspective view of the instant invention per se with the belt opened.
Figure 4A:
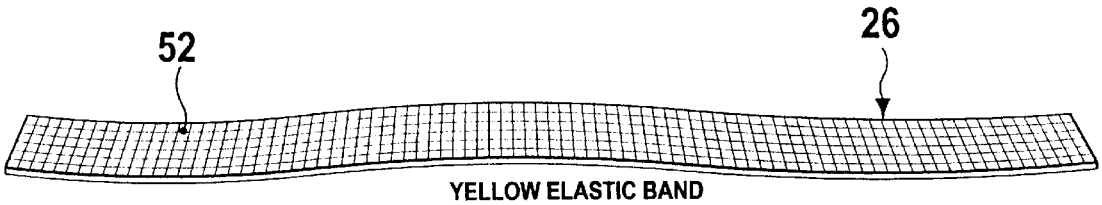
FIG. 4A to 4E are perspective view of a plurality of interchangeable varying resistance color coded elastic bands as indicated in FIGS. 1, 2, 3 and 5.
Figure 4B:
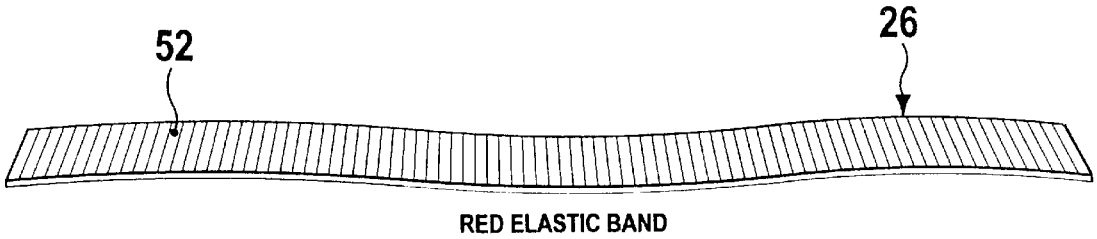
Figure 4C:
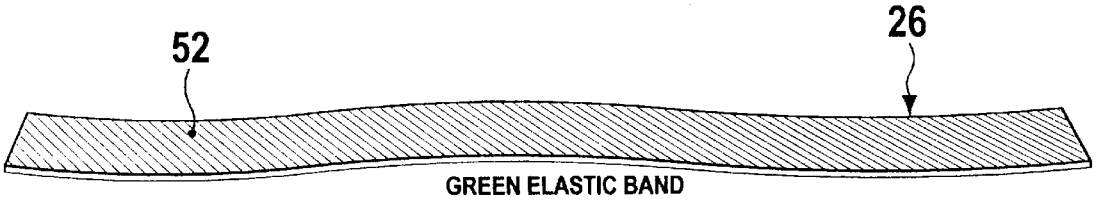
Figure 4D:
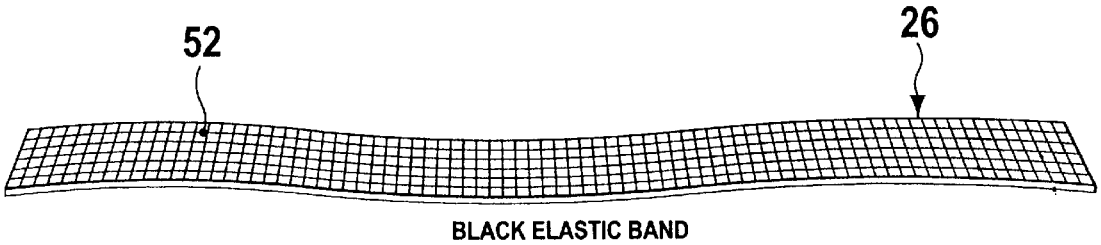
Figure 4E:
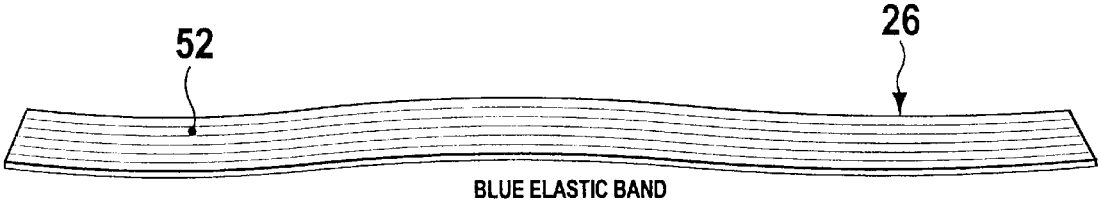
Figure 5:
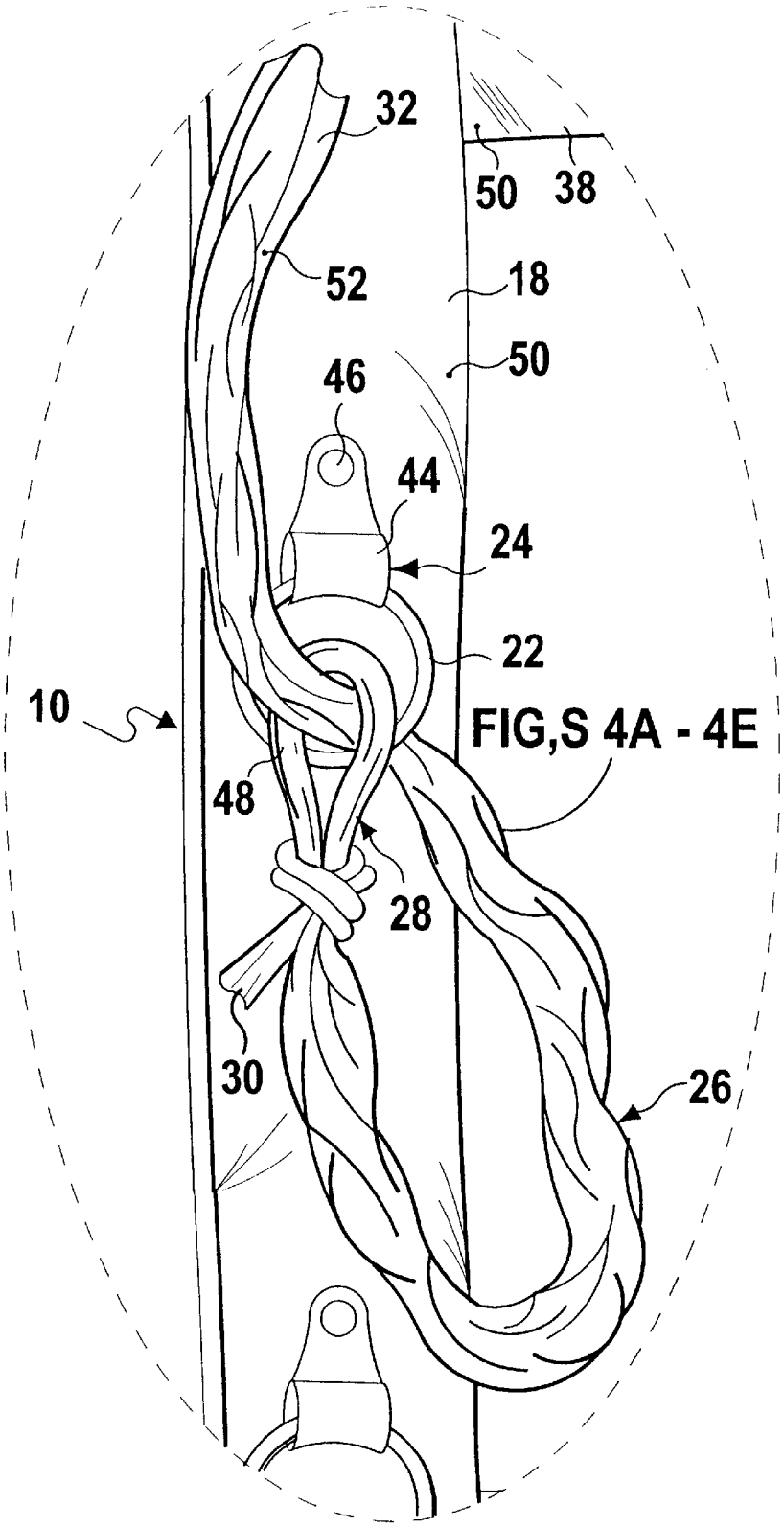
FIG. 5 is an enlarged perspective view of the area in FIG. 3 as indicated by arrow 5.
Figure 6:
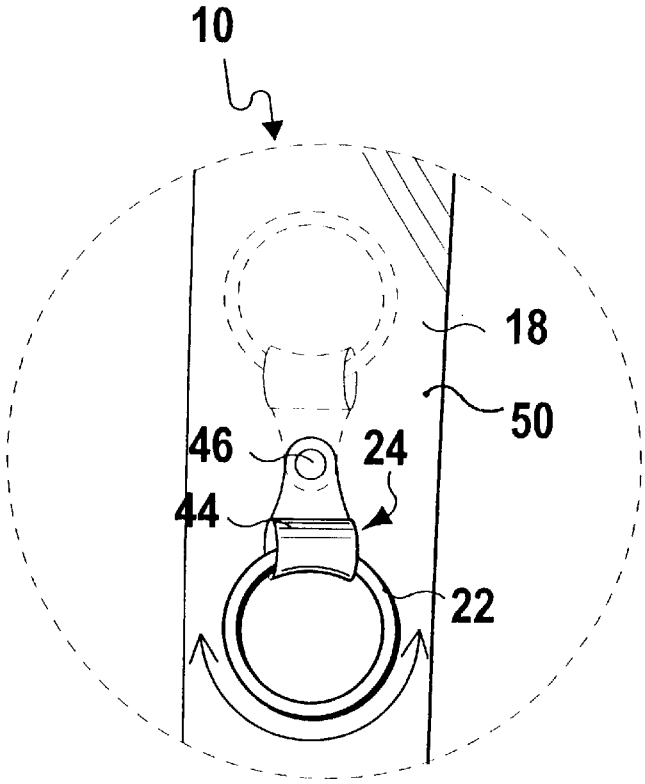
FIG. 6 is an enlarged perspective view of the area in FIG. 2 as indicated by arrow 6.
Figure 7:
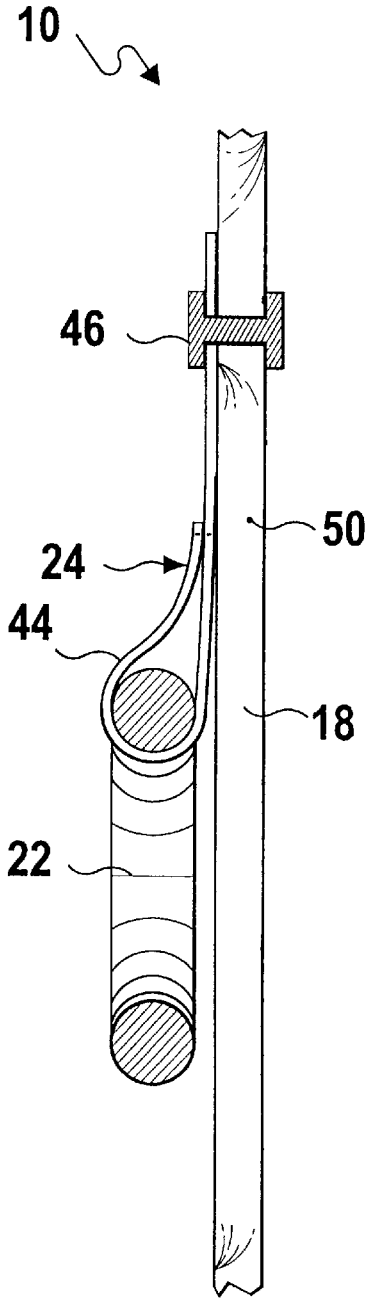
FIG. 7 is an enlarged cross sectional view taken along line 7—7 in FIG. 2.

A chest strap 38 is secured to and extends between the shoulder straps 18, so as to hold the shoulder straps 18 in place on the torso 20 of the person 16. The belt 12, as best seen in FIG. 3, is adjustable and includes a pair of VELCRO (hook and loop fastening) pads 40, 42 at opposite ends of the belt 12, so that the belt 12 can be secured firmly to the waist 14 of the person 16 when the VELCRO pads 40, 42 mate with each other.

The affixing structure 24 consists of a plurality of loop fasteners 44 to engage with the rings 22. A plurality of pivot rivets 46 are for mounting the loop fasteners 44 to the shoulder straps 18 and belt 12.

Each elastic band 26, as best seen in FIGS. 4A to 4E, is color coded to indicate the different varying resistances thereof. The colors can be yellow, red, green, black and blue, as shown, but other colors can be utilized to indicate the different varying resistances. The attaching facility 28 consists of the first end 30 of the elastic band 26 tied into a loop knot 48, so that the second end 32 of the elastic band 26 can be inserted through one ring 22 and the loop knot 48.

The belt 12 is fabricated out of a cloth material 50. Each shoulder strap 18 is fabricated out of the cloth material 50, while the chest strap 38 is also fabricated out of the cloth material 50. Each elastic band 26 is fabricated out of a stretchable latex material 52.

OPERATION OF THE INVENTION

To use the arm/shoulder exercise walking vest 10, the following steps should be taken:

1. Choose one of the elastic bands 26 by its color to determine its resistance.
2. Make a loop knot 48 at the first end 30 of the elastic band 26.
1. Insert the second end 32 of the elastic band 26 through any one ring 22 on the shoulder strap 18 or belt 12 and through the loop knot 48.
4. Pull the elastic band 26 through any other ring or rings 22 on the shoulder strap 18.
5. Place the shoulder straps 18 over the torso 20 of the person 16.
6. Wrap the belt 12 about the waist 14 of the person 16.
7. Mate the VELCRO pads 40 and 42 together, so that the belt 12 will be secured firmly to the waist 14.
8. Grasp the second end 32 of the elastic band 26 by a hand 34, to exercise an arm/shoulder 36 while walking.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of exercising an arm and shoulder while walking comprising the steps of:

a) wearing a vest while walking, said vest comprising a waist belt, a pair of shoulder straps extending up from said belt along the front of said person over the shoulders and down to said belt on the other side of said person, a plurality of spaced rings affixed on said shoulder straps along the front and back of said person and said belt, and a plurality of fully detached elastic bands of varying resistances color coded to the different resistances thereof;

b) selecting and attaching by loop knot a first end of one of said elastic bands to one of said rings and looping said the elastic band through one of the other said rings and grasping with a hand and pulling a second end of said elastic band in a direction as determined by the ring through which said elastic band is looped for exercising an arm or a shoulder while walking.

* * * * *